US005383510A

United States Patent [19]

Allen

[11] Patent Number: 5,383,510

[45] Date of Patent: Jan. 24, 1995

[54] APPARATUS AND METHOD FOR RAPIDLY AND RELIABLY SEALING OFF CERTAIN OPENINGS IN RESPONSE TO SMOKE, NOXIOUS FUMES OR CONTAMINATED AIR

[76] Inventor: Thomas H. Allen, 2004 N. Tenth St., Boise, Id. 83702

[21] Appl. No.: 225,508

[22] Filed: Apr. 11, 1994

Related U.S. Application Data

[63] Continuation of Ser. No. 933,491, Aug. 21, 1992, abandoned, which is a continuation-in-part of Ser. No. 744,079, Aug. 12, 1991, Pat. No. 5,195,594.

[51] Int. Cl.[6] ..... E06B 9/56

[52] U.S. Cl. ..... 160/310; 160/243

[58] Field of Search ..... 160/243, 1, 6, 7, 268.1, 160/273.1, 9, 244, 245, 310, 266, DIG. 7; 169/48, 51

[56] References Cited

U.S. PATENT DOCUMENTS

| | | | |
|---|---|---|---|
| 862,644 | 8/1907 | Kepler | 160/243 X |
| 2,582,276 | 1/1952 | Powers | 160/243 |
| 3,006,352 | 10/1961 | Hozak | 160/310 X |
| 3,016,952 | 1/1962 | Shero | 160/354 |
| 3,306,345 | 2/1967 | Youngs | 160/243 |
| 3,398,779 | 8/1968 | Kuss | 160/243 |
| 3,687,185 | 8/1972 | Singer | 160/1 |
| 3,766,958 | 10/1973 | Mitchell | 160/84 R |
| 3,807,480 | 4/1974 | Smart | 160/1 |
| 3,877,525 | 4/1975 | Husson et al. | 160/1 X |
| 3,960,216 | 6/1976 | Isobe | 169/48 |
| 4,077,474 | 3/1978 | Hattori | 160/1 X |
| 4,079,772 | 3/1978 | Klaenhammer et al. | 160/268.1 |
| 4,398,371 | 8/1983 | Jenkins | 49/7 |
| 4,802,523 | 2/1989 | Scholten et al. | 160/354 |
| 5,195,594 | 3/1993 | Allen et al. | 160/243 X |

FOREIGN PATENT DOCUMENTS

| | | | |
|---|---|---|---|
| 2617230 | 12/1088 | France | 169/48 |
| 560833 | 4/1975 | Switzerland | 160/243 |
| 2060744 | 5/1981 | United Kingdom | 160/268.1 |
| 2108839 | 5/1983 | United Kingdom | 169/48 |

*Primary Examiner*—David M. Purol
*Attorney, Agent, or Firm*—Seed and Berry

[57] ABSTRACT

A method and apparatus for rapidly and reliably sealing off a selected opening from an adjacent path of smoke, noxious fumes or contaminated air which comprises a reel of reinforced transparent, temperature, chemical or radiation resistant material having flexible magnetic edge strips on each side thereof mounted and centered above said opening, and causing the reel to drop in vertical fall adjacent to the opening and simultaneously causing the flexible magnetized strips to become rapidly and magnetically attached to ferromagnetic side rails or ferromagnetic door frame used for fire doors and to expand under pressure while maintaining an air tight seal of the opening. This apparatus is elegantly simple and reliable in both its construction and operation and has an extremely high price/performance figure of merit.

48 Claims, 2 Drawing Sheets

APPARATUS AND METHOD FOR RAPIDLY AND RELIABLY SEALING OFF CERTAIN OPENINGS IN RESPONSE TO SMOKE, NOXIOUS FUMES OR CONTAMINATED AIR

CROSS-REFERENCE TO RELATED APPLICATION

This application is a continuation of U.S. patent application Ser. No. 07/933,491, filed Aug. 21, 1992, now abandoned which is a continuation-in-part of U.S. patent application Ser. No. 07/744,079 filed Aug. 12, 1991, now U.S. Pat. No. 5,195,594.

TECHNICAL FIELD

This invention relates generally to safety apparatus for shielding humans from harmful exposure to smoke, noxious fumes or contaminated air. More particularly, the safety apparatus described herein responds to conditions of dangerous or contaminated air and reliably seals off certain openings while simultaneously affording entry or exit through the sealed off area if such becomes necessary.

BACKGROUND ART AND RELATED APPLICATIONS

In order to protect humans against smoke, noxious fumes or contaminated air which may erupt in a variety of building structures, particularly in office buildings, hotels, manufacturing plants, mines, and the like, many different types of shielding devices have been developed over the years which are operative to seal off certain openings through which smoke, noxious fumes or contaminated air are likely to travel. As is well known, many deaths and much property damage are the result of smoke, noxious fumes or air contamination, so there have been various different approaches proposed to rapidly sealing off areas adjacent to which smoke, noxious fumes or contaminated air are likely to travel.

Examples of such prior patented approaches to sealing off certain openings are disclosed in:

U.S. Pat. No. 3,766,958 issued to Mitchell
U.S. Pat. No. 3,960,216 issued to Isobe
U.S. Pat. No. 4,077,474 issued to Hattori
U.S. Pat. No. 4,079,772 issued to Klaenhammer et al.
U.S. Pat. No. 4,398,371 issued to Jenkins all incorporated herein by reference.

Other prior approaches to sealing off openings for the purpose of isolation of smoke, noxious fumes or dangerous air conditions include horizontally and vertically deployed metal and plastic screens. These latter types of prior art sealing approaches have exhibited many operational disadvantages and have proven ineffective to provide an airtight seal. In addition, maintenance personnel can alter many of these schemes after installation which modifies their effectiveness at a time of emergency. Most if not all of the disadvantages associated with the above patented art as well as the latter prior art sealing approaches have been overcome by the new and useful improvements disclosed and claimed in my copending U.S. patent application Ser. No. 07/744,079 filed Aug. 14, 1991 and entitled APPARATUS AND METHOD FOR RAPIDLY AND RELIABLY SEALING OFF CERTAIN EXIT AND ENTRANCE WAYS IN RESPONSE TO SMOKE OR FIRE which is incorporated herein by reference.

DISCLOSURE OF THE INVENTION

The present application demonstrates still further new and useful improvements in this art and over my co-pending U.S. Patent application. Briefly summarized, the purpose, objectives and related advantages and novel features of this invention are accomplished by the provision of a new and improved method and apparatus including an apparatus for sealing off selected openings in response to smoke, noxious fumes or contaminated air which comprises a rolling flexible transparent reinforced curtain with flexible magnetic side strips along two sides which falls adjacent to and being rapidly attached to ferromagnetic side rails or ferromagnetic door frame in which the curtain expands to a predetermined limit and is wound onto a reel to which a pulley is attached at each end around which a cord is wound and whose free end is attached to a pulley connected to a drive means.

When fully deployed, the current invention resists up to 0.3 inches of water column pressure differential across the opening to be sealed within a temperature range between 50° F. and 450° F. for a minimum of 30 minutes while maintaining an air leakage rate of less than 1 cubic feet of air per minute per square foot of opening and expands at a controlled rate of 1" per foot of width and deploys in less than 10 seconds. This invention complies with the 1991 edition of the Uniform Building Code, Section 3305 (h) as a gasket system meeting the requirements of a tight fitting smoke and draft control assembly and complies with the National Fire Protection Agency Standard No. 105 Installation of Smoke-Control Door Assemblies, 1989 edition relating to smoke and draft control assemblies when tested under the procedures outlined in Underwriters Laboratory Subject 1784 Air Leakage Tests of Door Assemblies 1990 edition. The film developes a flame spread index of 0 and a smoke developed rating of 0 when tested in accordance with Uniform Building Code Standard No. 42-1.

DESCRIPTION OF THE PREFERRED EMBODIMENT

Figure 1:
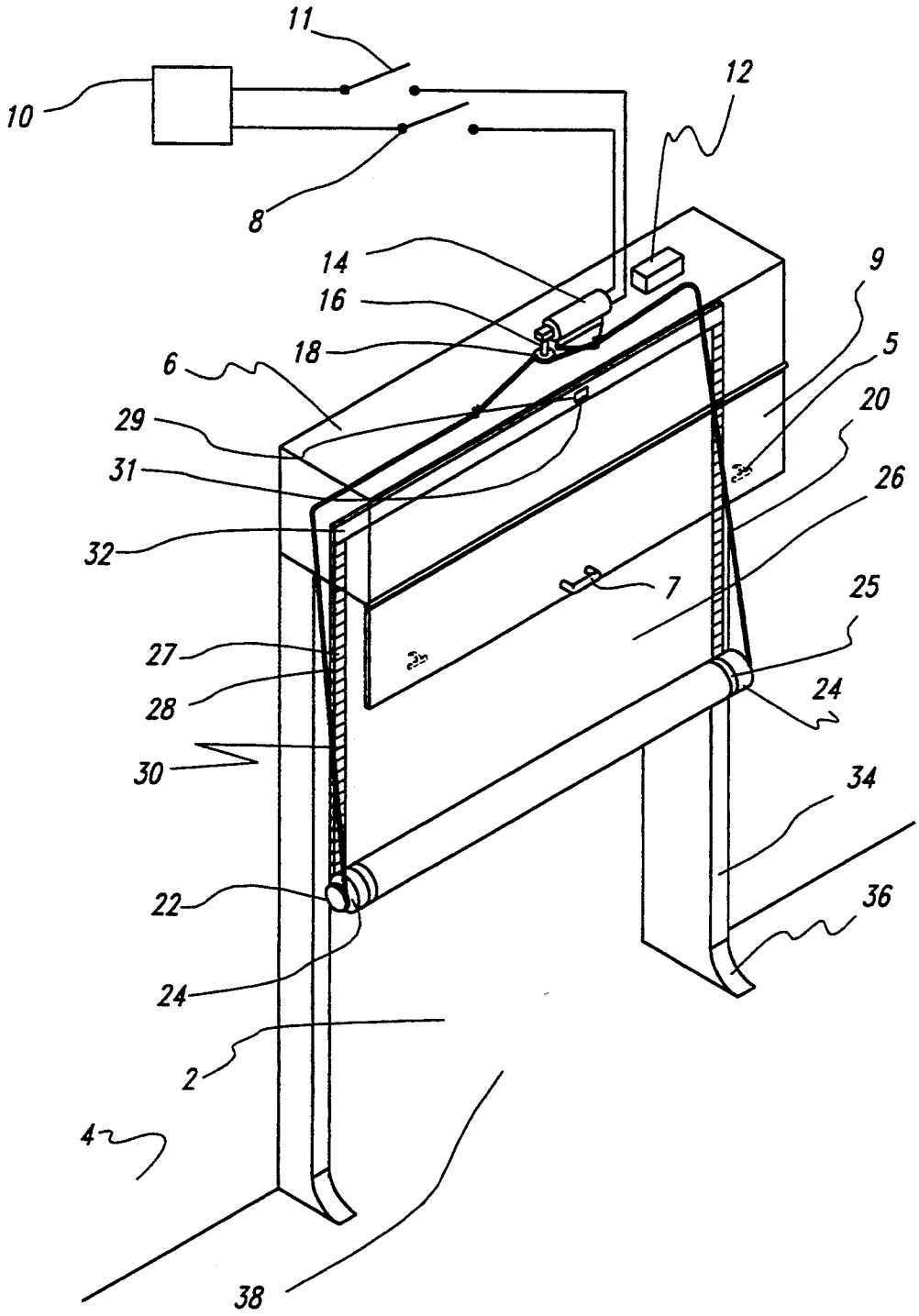
FIG. 1 is a view of the apparatus for rapidly and reliably sealing off an opening.

Referring to, FIG. 1, there is shown an opening 2 located in a wall 4 that is desired to be sealed against the passage of smoke, noxious fumes or contaminated air. Container 6 with a magnetic latch 7 attached to a hinged bottom flap 9 is mounted directly above and centered over opening 2. A catch 5 is attached to the hinged door and aligned with the end reels 24. A remote switch 8 sensitive to smoke, noxious fumes or contaminated air is connected to an auxiliary energy source 10 which is connected to a limit switch 12 sensitive to the tension in the connecting cord 20 and a remote rewind switch 11 connected to a drive means 14. The shaft 16 of the drive means 14 is connected to the primary pulley 18 around which a connecting cord 20 is wound. The opposing end of the connecting cord 20 is connected to and wound around the secondary pulley 22 which is attached to the end reels 24. The neutral axis of the reinforced curtain 26 is aligned with the neutral axis of the flexible magnetic strip 28 along each side of the curtain 26 and attached with an expandable joint 25 and wound around the end reels 24. A series of ferromagnetic segments 27 are attached to the flexible magnetic strip 28 to allow a space 30. The alignment bar 32 is attached to the top of the curtain 26 and flexible magnetic strip 28 and contains a hole 29 at its center which is aligned and connected to the bolt 31 attached to the container 6. The alignment bar 32 centeres the flexible magnetic strip 28 directly above the ferromagnetic side rails 34 located at each side of the opening 2. A ferromagnetic cove base 36 is attached to the bottom of the ferromagnetic side rail 34 and sized to fit the diameter of the end reels 24 when the curtain 26 reaches the floor 38.

Figure 2:
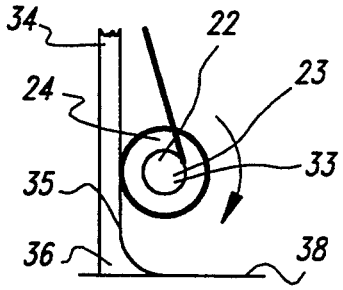
FIG. 2 is a side view of the end reel shown prior to reaching the floor.

Referring to FIG. 2, the end reel 24 is shown before reaching the floor 38. The ferromagnetic cove base 36 is shown in relationship to the ferrogmagnetic side rail 34 forming a smooth surface transition 35. The secondary pulley 22 around which the connecting cord 20 is wound is attached to the end reel 24 with a bolt 23 through a slotted hole 33 in the end reel 24.

Figure 3:
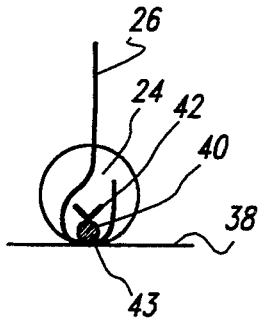
FIG. 3 is a cross sectional view of the flexible container with the self leveling material wrapped around the spacing bar.

Referring to FIG. 3, the reinforced curtain 26 wraps between the floor 38 and the flexible container 40 filled with a self leveling material 43 which is wrapped around the spacing bar 42. The end reel 24 is shown in the background for reference.

Figure 4:
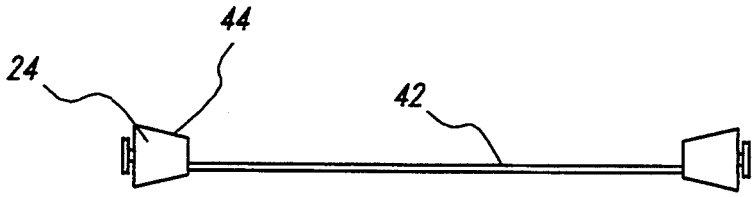
FIG. 4 is a top view of the tapered end reels connected to the spacing bar.

Referring to FIG. 4, the taper 44 of the end reels 24 are shown connected to the spacing bar 42.

The curtain is essentially comprised of 2 mil thick polyimide film reinforced with 200 denier nomex yarn spaced ¼ inch each way. The reinforcing fill yarn must be attached to the film and overlap the unadhered reinforcing warp yarn. The bond between the yarn and the film must be at least two pounds per inch. The film is connected along its length to a 2½ inch wide by 0.125 inch thick PM 14 multi-pole flexible magnet of energized ferrite in a nitrile rubber binder exerting minimum 1.4 MGOe of force. The multi-poles are oriented along the length, perpendicular to the magnet width and visible on the strong face of the magnet. The film and magnets are aligned relative to their neutral axes and connected with a 0.5 inch wide by 0.125 inch thick continuous joint of low-modulus silicone. Two 1/8 inch wide strips of 0.002 inch synthetic elastomer, two stage, laminating adhexive developing a thermoset bond above 350° F. are continuously attached at third points along the length of the strong face of the flexible magnet. Full hard, cold rolled steel strips measuring 5/8 inch long, 2¼ inch wide by 0.004 inch thick are spaced at 11/16 inch on center along the weak face of the flexible magnet and attached with 0.005 inch thick acrylic transfer adhesive.

OPERATION

When smoke, noxious fumes or contaminated air are detected adjacent to the opening 2, an electrical contact is closed in a remote switch 8 and the drive means 14 is activated to turn a primary pulley 18 releasing a controlled amount of a connecting cord 20 which in turn allows the secondary pulley 22 located at each end of the end reels 24 to unwind deploying the transparent, reinforced curtain 26 with flexible magnetic edge strips 28 in alignment with the ferromagnetic side rails 34 and rapidly attracting the flexible magnetic strips 28 to the ferromagnetic rails 34. The downward action of the unrolling of the reinforced curtain 26 overcomes the holding power of the magnetic door latch 7 opening the bottom flap 9 of the container 6 and allows the reinforced curtain 26 to unroll. The limit switch 12 sensitive to the tension in the connecting cord 20 opens a circuit immediately stopping the flow of power to the drive means 14 and immediately short circuiting the energy remaining in the motor coil when the curtain is fully deployed and the connecting line 20 becomes slack. When the reinforced curtain 26 has been fully deployed at the floor 38 a ferromagnetic cove base 36 which is sized to the diameter of the end reels 24 and attached to the floor 38 in alignment with the ferromagnetic rails 34 allowing the magnetic edge strips 28 to become attracted to the cove bases 36. When the reinforced curtain 26 reaches the floor 38 a flexible container 40 partially filled with a self leveling material 43 compresses over a portion of the reinforced curtain 26 against the floor 38. As the curtain 26 expands under pressure, the connection between the reinforced curtain 26 and the flexible magnetic edge strips 28 stretches a predetermined amount to limit the amount of expansion and the reinforced curtain 26 slips under the flexible container 40 without disturbing the seal at the floor 38 or pushing the end reels 24 away from the ferromagnetic rails 34. The apparatus is rewound by closing an electrical contact 11 at a remote location and activating the drive means 14 to turn the primary pulley 18 in the opposing direction winding the connecting cord 20 from the secondary pulleys 22 onto the primary pulley 18 and rolling the reinforced curtain 26 upwards into the container 6 closing the bottom flap 9 when the end reels 24 meet the catch 5 mounted to the bottom flap 9 and opening the rewind contact 11 allowing the apparatus to be deployed again.

Various modifications may be made in and to the above described embodiment without departing from the spirit and scope of this invention. For example, the present invention is not limited to the use of any particular types of drive means and can include controlling an electrical impulse to a gear motor, altering the magnetic forces in the flexible magnetic strips, altering the thickness or configuration of the metallic edge strips attached to the flexible magnetic strips, controlling the rate of release of the line by utilizing a hydraulic clutch, geared clutch, friction clutch, mechanical displacement system, fluid displacement system, or the like.

The control of the winding of the line is not limited to the use of pulleys but may also include wrapping the line between the flexible magnetic strips and the ferromagnetic frame.

Providing a method to allow a uniform winding of the apparatus is not limited to utilizing a flat profile connecting cord but may also include a round cord aligned and contained in a grooved spool, or the like.

Providing a method to allow a uniform winding of the apparatus is not limited to aligning the film and flexible magnetic strips along their respective neutral axes but may also include attaching the film and flexible magnetic strips with a high strength adhesive, or the like.

Reinforcing the curtain is not limited by the spacing of the reinforcing on the film, type of reinforcing or the adhesive with which the reinforcing is attached to the film.

Allowing the film to expand at a predetermined rate under pressure is not limited to the joint between the film and the flexible magnetic strips but may also include folding the film or occur in the film or flexible magnetic strips.

Allowing the film to expand under pressure while maintaining an airtight seal is not limited to utilizing end reels connected to a spacing bar but may also include folding the film at the bottom of the curtain, attaching the film to the end reels with an expanding connection, and the like. Sizing the diameter of the end reels to prevent stressing of the flexible magnets when rolling and un-rolling is not limited to the use of a 4"Ø cylinder but may also include different shaped end reels,different magnetic binders, and the like.

The time to deploy the curtain is not limited to 10 seconds but may also include lesser times and greater times.

The width of the ferromagnetic rails is not limited to 2" in width but may include any width.

The ferromagnetic rails are not limited to additional rails but may also include ferromagnetic door frames, or the like.

Control of the apparatus from a remote area or deploying a plurality of curtains is not limited to a direct wired system but may include any method of signal.

Providing reliable power to the apparatus is not limited to the use of a low voltage battery and charger but can include any alternative energy source.

Reliably sealing the area between the ferromagnetic rails and the end reels when the curtain is fully deployed is not limited to utilizing a ferromagnetic cove base sized to the diameter of the cylinder but may also include triangular shaped end reels, utilizing a compressible material attached to the flexible magnetic strips, or the like.

Reliably sealing the area between the film and the floor when the curtain is fully deployed is not limited to utilizing a container filled with a self leveling material but may also include a compressible material, a radius shaped spacing bar, or the like.

Constant tension on the connecting cord is not limited to utilizing a limit switch which activates a relay causing the energy field in the electric motor to be shorted wherein the turning of the motor is instantaneously stopped but may include weights suspended on the line connected to the container located to center upon the length of line but may also include a braking system to stop the motor precisely, providing a pulsing or timed reverse current to the motor upon stopping, or the like.

Reliably raising and lowering the reel a predetermined distance is not limited to utilizing limit switches but may also include a distance sensing mechanism, a potentiometer set to time the deployment, a magnetic reed switch that is sensitive to a particular point in the connecting cord, an optic reader to sense distance, a mechanical counter to measure travel distance of the connection cord, a mechanical counter to measure the revolutions of the pulley, a voltage switch sensitive to the load on the motor, or the like.

The current invention is not limited to a fire resistive surface mounted container but may also include a container that can be recessed into the wall or ceiling above the opening, creating a fire resistive recessed area above the opening, providing a transom type installation above a door, or the like.

Controlling the buckeling of the ferromagnetic segments attached along the length of the flexible magnets caused by differential rolling diameters is not limited to providing a space between the ferromagnetic segments but may also include different adhesives, non directional flexible magnetic strips, or the like.

Mounting the curtain in a plumb condition is not limited to attaching the curtain to a leveling bar but may also include fixing the top of the curtain to the container, or the like.

Providing a passive latch for the hinged container door is not limited to the use of a magnetic door latch but may include a mechanical latch, spring hinge, or the like.

Accordingly, it is to be understood that the above and other unspecified design and operational modifications may be made by those skilled in the art without departing from the scope of the following appended claims.

I claim:

1. An apparatus for rapidly and reliably sealing off an opening defined at a lower limit by a floor in response to smoke, noxious fumes, or contaminated air, comprising:

a curtain of temperature, chemical or radiation resistant flexible material reinforced to limit ripping of the curtain if penetrated or punctured;

a flexible magnetic strip means attached to and extending along each of the left and right edges of the curtain;

an expansion means attached to the curtain to allow expanding movement of the curtain in response to differential pressure after deployed;

a fire resistive container located adjacent to an upper limit of the opening;

a reel means initially positioned within the container and upon which the curtain is wound in preparation for deployment, the reel means being movable downward and upward across the opening, the reel means being rotated to unroll the curtain from the reel means in a position adjacent to the opening as the reel means moves downward, and rotated to subsequently rewind the curtain onto the real means as the reel means moves upward to allow passage through the opening;

a powered, automatic drive means connected to the reel means to brake the downward movement of the reel means and rotate the reel in one rotational direction as the reel moves downward to unroll the curtain and to move the reel means upward and rotate the reel in an opposite rotational direction as the reel means moves upward to rewind the curtain onto the reel means;

a deployment control means which stops the drive means to limit the downward movement of the reel means and the unrolling of the curtain when the curtain is at a position adjacent to the floor;

a rewind control means which stops the drive means to limit the upward movement of the reel means and the rewinding of the curtain onto the reel means;

a bottom seal means which resists air leakage between the curtain and the floor when the curtain is positioned adjacent to the floor;

a ferrous metal frame means attached to the wall directly adjacent to each of the left and right sides of the opening, the curtain being sized such that as the curtain unrolls from the reel means as the reel means moves downward, the flexible magnetic strip means attached to each edge of the curtain is magnetically attached to a corresponding one of the frame means; and a ferrous metal seal means located at the junction of a lower end of each of the frame means and against the floor such that when the curtain is positioned adjacent to the floor the flexible magnetic strip means attached to each edge of the curtain is magnetically attached to a corresponding one of the seal means to resist air leakage between the curtain and the seal means.

2. The apparatus of claim 1 wherein the curtain is reinforced with a temperature, chemical or radiation resistant yarn.

3. The apparatus of claim 1 wherein the curtain is transparent.

4. The apparatus of claim 1 wherein the expansion means is attached to the curtain at a position between the curtain and the flexible magnetic strip means to allow for controlled expansion.

5. The apparatus of claim 4 wherein the expansion means is sized to allow expanding movement of the curtain under 0.3 in wg. pressure at a controlled rate of 1 inch per foot of opening width.

6. The apparatus of claim 5 wherein the curtain maintains a virtual airtight seal of the opening when expanded under pressure.

7. The apparatus of claim 1 wherein the reel means includes left and right end reels sized to match the rolling diameter of the flexible magnetic strip means.

8. The apparatus of claim 7 wherein the left and right end reels are held spaced apart by a connecting element extending therebetween to align each of the left and right end reels with a corresponding one of the flexible magnetic strip means.

9. The apparatus of claim 8 wherein the expansion means permits the curtain to expand between the left and right end reels under pressure.

10. The apparatus of claim 7 wherein the left and right end reels are each tapered inward to create a greater rolling diameter at the corresponding left and right edges of the curtain.

11. The apparatus of claim 1 wherein the drive means includes drive pulley and at least one connecting cord extending to and operatively engaging the reel means.

12. The apparatus of claim 11 wherein the reel means includes a reel pulley and the connecting cord operatively engages the reel pulley.

13. The apparatus of claim 12 wherein the reel means further includes at least one end reel with the reel pulley attached to the outside end of the end reel.

14. The apparatus of claim 13 wherein the attachment of the reel pulley to the end reel is adjustable about its center axis.

15. The apparatus of claim 1 wherein the flexible magnetic edge strip means comprises ferromagnetic segments with substantially evenly distributed spaces therebetween.

16. The apparatus of claim 1 wherein the curtain has a neutral axis aligned with a neutral axis of the flexible magnetic strip.

17. The apparatus of claim 1 wherein the drive means includes a motor attached to a gear mechanism.

18. The apparatus of claim 17 wherein the drive means further includes a pulley attached to a drive shaft of the gear mechanism.

19. The apparatus of claim 18 further including a connecting chord attached to said pulley and extending to and operatively engaging the reel means.

20. The apparatus of claim 17 wherein the motor and gear mechanism unrolls and rewinds the curtain on the reel means in less than 10 seconds.

21. The apparatus of claim 17 wherein the motor is connected to an emergency energy supply.

22. The apparatus of claim 21 wherein the motor is an electric motor and the emergency energy supply is a low voltage battery with a constant float type battery charger.

23. The apparatus of claim 17 wherein the deployment control means and the rewind controls means are located in a remote location.

24. The apparatus of claim 1 wherein the drive means includes a connecting cord extending to and operatively engaging the reel meads and the deployment control means is a limit switch sensitive to the tension in the connecting cord.

25. The apparatus of claim 24 further including a relay and wherein the drive means further includes a motor with the turning of the motor being stopped when the limit switch closes the relay, the relay being connected such that the closure causes the remaining energy field in the electric motor to be shorted.

26. The apparatus of claim 1 wherein the deployment control means includes a deployment control switch which controls operation of the drive means, and the rewind control means includes two relays interconnected to prevent the rewinding of the curtain on the reel means while the deployment control switch is energized.

27. The apparatus of claim 1 wherein the bottom seal means includes a flexible container of temperature, chemical or radiation resistant material.

28. The apparatus of claim 27 wherein the flexible container contains a self leveling material that is resistant to temperature, chemicals or radiation.

29. The apparatus of claim 1 wherein the frame means includes a pair of side rails of ferrous metal that is 2″ wide with a ½ return at each edge thereof.

30. The apparatus of claim 29 wherein the side rails are each attached to a subframe member.

31. The apparatus of claim 30 wherein the subframe members are attached to a wall in which the opening is formed adjacent to the opening.

32. The apparatus of claim 31 wherein the reel means includes left and right end reels and the ferrous metal seal means includes left and right cove base members sized to the diameter of a corresponding one of the left and right end reels.

33. The apparatus of claim 32 wherein the frame means includes left and right ferrous metal side rails and the left and right cove base members are attached to the floor in vertical alignment with a corresponding one of the left and right side rails.

34. The apparatus of claim 33 wherein the left and right cove base members are attached to a corresponding one of the left and right side rails.

35. The apparatus of claim 1 wherein the container has walls of 1″ thick gypsum covered with 20 gauge metal.

36. The apparatus of claim 35 wherein the container includes a hinged bottom flap held closed by a permanent magnetic latch prior to deployment of the curtain.

37. The apparatus of claim 1 further including a leveling bar adjustably attaching the curtain to the container to permit leveling of the curtain relative to the frame means.

38. The apparatus of claim 37 wherein the leveling bar contains a hole at its center which is attached to the container by a bolt centered in the container.

39. An apparatus for sealing off selected openings in response to smoke, noxious fumes or contaminated air, comprising a transparent temperature, chemical or radiation resistant curtain reinforced with a yarn that is resistant to temperature, chemicals or radiation and having a pair of flexible magnetic edge strips connected to the curtain and aligned to be disposed along a pair of ferromagnetic side rails, each side rail being located at one side of an opening, the curtain being expandable under pressure while the flexible magnetic edge strips are magnetically attached to the side rails to maintain an air tight seal of the opening.

40. An apparatus for rapidly and reliably sealing off an opening defined at a lower limit by a floor in response to smoke, noxious fumes, or contaminated air, comprising:

a curtain of temperature, chemical or radiation resistant flexible material;

a flexible magnet strip means attached to and extending along each of the left and right edges of the curtain;

a reel means upon which the curtain is wound in preparation for deployment, the reel means being movable downward and upward across the opening, the reel means being rotated to unroll the curtain from the reel means in a position adjacent to the opening as the reel means moves downward, and rotated to subsequently rewind the curtain onto the reel means as the reel means moves upward to allow passage through the opening;

a powered, automatic drive means connected to the reel means to brake the downward movement of the reel means and rotate the reel in one rotational direction as the reel moves downward to unroll the curtain and to move the reel means upward and rotate the reel in an opposite rotational direction as the reel means moves upward to rewind the curtain onto the reel means;

a deployment control means which stops the drive means to limit the downward movement of the reel means and the unrolling of the curtain when the curtain is at a position adjacent to the floor;

a rewind control means which stops the drive means to limit the upward movement of the reel means and the rewinding of the curtain onto the reel means; and a ferrous metal frame means attached to the wall directly adjacent to each of the left and right sides of the opening, the curtain being sized such that as the curtain unrolls from the reel means as the reel means moves downward the flexible magnetic strip means attached to each edge of the curtain is magnetically attached to a corresponding one of the frame means.

41. The apparatus of claim 40 wherein the curtain is reinforced to limit ripping of the curtain if penetrated or punctured.

42. The apparatus of claim 40 further including an expansion means attached to the curtain to allow expanding movement of the curtain in response to differential pressure after deployed.

43. The apparatus of claim 40 further including a bottom seal means which resists air leakage between the curtain and the floor when the curtain is positioned adjacent to the floor.

44. The apparatus of claim 40 further including a ferrous metal frame means and against the floor such that when the curtain is positioned adjacent to the floor the flexible magnetic strip means attached to each edge of the curtain is magnetically attached to a corresponding one of the seal means to resist air leakage between the curtain and the seal means.

45. An apparatus for rapidly and reliably sealing off an opening defined at a lower limit by a floor in response to smoke, noxious fumes, or contaminated air, comprising:

a curtain of temperature, chemical or radiation-resistant flexible material;

a flexible magnet strip attached to and extending along each of the left and right edges of the curtain; and an expansion member attached to the curtain at a position between the curtain and at least one of the flexible magnetic strips to allow for controlled expansion.

46. The apparatus of claim 45 wherein the position of the expansion member is located along a neutral axis of the curtain and a neutral axis of the flexible magnet strip.

47. An apparatus for rapidly and reliably sealing off an opening defined at a lower limit by a floor in response to smoke, noxious fumes, or contaminated air, comprising:

a curtain of temperature, chemical or radiation-resistant flexible material;

a flexible magnet strip attached to and extending along each of the left and right edges of the curtain;

an expansion member connected to the curtain and to each of the flexible magnetic strips to allow expanding movement of the curtain in response to differential pressure after being deployed; and a reel sized to allow the expanding movement of the curtain in response to differential pressure after being deployed.

48. The apparatus of claim 47, further including:

a powered drive connected to the reel to brake the downward movement of the reel and rotate the reel in one rotational direction as the reel moves downward to unroll the curtain and to move the reel upward and rotate the reel in an opposite rotational direction as the reel moves upward to rewind tile curtain onto the reel;

a deployment control which stops the drive to limit the downward movement of the reel and the unrolling of the curtain when the curtain is at a position adjacent to the floor;

a rewind control which stops the drive to limit the upward movement of the reel and the rewinding of the curtain onto the reel; and an emergency energy supply connected to the drive.

* * * * *

UNITED STATES PATENT AND TRADEMARK OFFICE

CERTIFICATE OF CORRECTION

PATENT NO. : 5,383,510

DATED : January 24, 1995

INVENTOR(S) : Thomas H. Allen

It is certified that error appears in the above-indentified patent and that said Letters Patent is hereby corrected as shown below:

In column 6, claim 1, line 38, please delete "real" and substitute therefor --reel--.

In column 8, claim 24, line 15, please delete "meads" and substitute therefor --means--.

In column 8, claim 29, line 39, after "1/2" and before "return", please insert --"--.

In column 8, claim 32, line 45, please delete "31" and substitute therefor --1--.

In column 10, claim 48, line 53, please delete "tile" and substitute therefor --the--.

Signed and Sealed this

Eighth Day of August, 1995

*Attest:*

Bruce Lehman

BRUCE LEHMAN

*Attesting Officer*

*Commissioner of Patents and Trademarks*